US010894330B2

(12) United States Patent
Goeder et al.

(10) Patent No.: US 10,894,330 B2
(45) Date of Patent: Jan. 19, 2021

(54) SHAVING RAZOR SYSTEM

(71) Applicant: The Gillette Company LLC, Boston, MA (US)

(72) Inventors: Philipp Goeder, Kronberg (DE); Benjamin Heinrich Niestroj, Kronberg (DE); Klaus Heubach, Kronberg (DE)

(73) Assignee: The Gillette Company LLC, Boston, MA (US)

( * ) Notice: Subject to any disclaimer, the term of this patent is extended or adjusted under 35 U.S.C. 154(b) by 60 days.

(21) Appl. No.: 16/367,318

(22) Filed: Mar. 28, 2019

(65) Prior Publication Data

US 2019/0299466 A1 Oct. 3, 2019

Related U.S. Application Data

(60) Provisional application No. 62/650,368, filed on Mar. 30, 2018.

(51) Int. Cl.

| | |
|---|---|
| ***B26B 21/48*** | (2006.01) |
| ***B26B 21/40*** | (2006.01) |
| ***B26B 21/52*** | (2006.01) |
| *B26B 21/02* | (2006.01) |
| *B26B 21/22* | (2006.01) |

(52) U.S. Cl.

CPC ..... *B26B 21/48* (2013.01); *B26B 21/4056* (2013.01); *B26B 21/4062* (2013.01); *B26B 21/526* (2013.01); *B26B 21/02* (2013.01); *B26B 21/22* (2013.01)

(58) Field of Classification Search

CPC ..... B26B 21/22; B26B 21/48; B26B 21/4056; B26B 21/02; B26B 21/526; B26B 21/4062

USPC ..... 30/34.05

See application file for complete search history.

(56) References Cited

U.S. PATENT DOCUMENTS

| | | | | |
|---|---|---|---|---|
| 2006/0070242 | A1* | 4/2006 | Szczepanowski | B26B 21/48 30/140 |
| 2009/0255123 | A1 | 10/2009 | Tomassetti | |
| 2012/0227554 | A1* | 9/2012 | Beech | B26B 21/4056 83/13 |
| 2012/0234658 | A1* | 9/2012 | Schnak | H01H 13/023 200/313 |
| 2012/0279075 | A1* | 11/2012 | Amsel | B26B 21/528 30/526 |

(Continued)

FOREIGN PATENT DOCUMENTS

| | | |
|---|---|---|
| EP | 3166760 B1 | 3/2018 |

OTHER PUBLICATIONS

International Search Report PCT/US2019/023063 dated May 29, 2019, 13 pages.

*Primary Examiner* — Hwei-Siu C Payer
(74) *Attorney, Agent, or Firm* — John M. Lipchitz

(57) ABSTRACT

A shaving razor system with a handle and a shaving cartridge mounted to the handle. A circuit board having an electrical switch in communication with a power source is positioned within the handle. A heating element is in electrical communication with the electrical switch. The heating element having a skin contacting surface. The heating element has a first pre-determined temperature and a second pre-determined temperature. The second predetermined temperature is at least two degrees Celsius different from the first pre-determined temperature.

18 Claims, 7 Drawing Sheets

(56) References Cited

U.S. PATENT DOCUMENTS

| | | | | |
|---|---|---|---|---|
| 2013/0199348 | A1* | 8/2013 | Aberizk | B26B 21/405 83/14 |
| 2014/0026423 | A1* | 1/2014 | Schnak | B26B 21/526 30/42 |
| 2015/0068043 | A1* | 3/2015 | Gester | B26B 21/48 30/34.05 |
| 2015/0135538 | A1* | 5/2015 | Tomassetti | B26B 21/48 30/45 |
| 2015/0197019 | A1 | 7/2015 | Hodgson | |
| 2016/0046028 | A1* | 2/2016 | Meier | B26B 21/4056 30/41 |
| 2019/0299466 | A1* | 10/2019 | Goeder | B26B 21/526 |

* cited by examiner

SHAVING RAZOR SYSTEM

FIELD OF THE INVENTION

The present invention relates to personal care products and more particularly to heated razors shaving.

BACKGROUND OF THE INVENTION

Users of wet-shave razors generally appreciate a feeling of warmth against their skin during shaving. The warmth feels good, resulting in a more comfortable shaving experience. Various attempts have been made to provide a warm feeling during shaving. For example, shaving creams have been formulated to react exothermically upon release from the shaving canister, so that the shaving cream imparts warmth to the skin. Also, various ways of delivering heat through the razor cartridge have also been proposed in the patent literature. Various patents have proposed heating a skin contacting surface of a shaving razor system, such as a heater bar on a shaving razor cartridge. It has also been proposed in the patent literature to heat the blades, which may decrease the force required to cut the hair. The shaving razor systems disclosed in the art are not very intuitive for consumers to use and thus may result in an inexperienced user not experiencing the beneficial warmth during a shave or being burned.

Accordingly, there is a need to provide a heated shaving razor with a simple and intuitive user interface that provides a safe and effective warming sensation during shaving.

SUMMARY OF THE INVENTION

The invention features, in general, a simple, efficient shaving razor system with a handle and a shaving cartridge mounted to the handle. A circuit board having an electrical switch in communication with a power source is positioned within the handle. A heating element is in electrical communication with the electrical switch. The heating element having a skin contacting surface. The heating element has a first pre-determined temperature and a second pre-determined temperature. The second predetermined temperature is at least two degrees Celsius different from the first pre-determined temperature.

The invention also features, in general, a simple, efficient shaving razor system with a handle. A shaving cartridge is mounted to the handle. An electrical switch is in communication with a microcontroller positioned within the handle. A heating element is in communication with the microcontroller. The heating element has a skin contacting surface. The heating element has a first pre-determined temperature set by the microcontroller and a second pre-determined temperature set by the microcontroller. The electrical switch has a first toggle time for changing back and forth between the first pre-determined temperature and the second pre-determined temperature and a second toggle time for changing back and forth between an on condition and an off condition. The first toggle time is greater than the second toggle time.

The details of one or more embodiments of the invention are set forth in the accompanying drawings and the description below. It is understood that certain embodiments may combine elements or components of the invention, which are disclosed in general, but not expressly exemplified or claimed in combination, unless otherwise stated herein.

Other features and advantages of the invention will be apparent from the description and drawings, and from the claims.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1A:
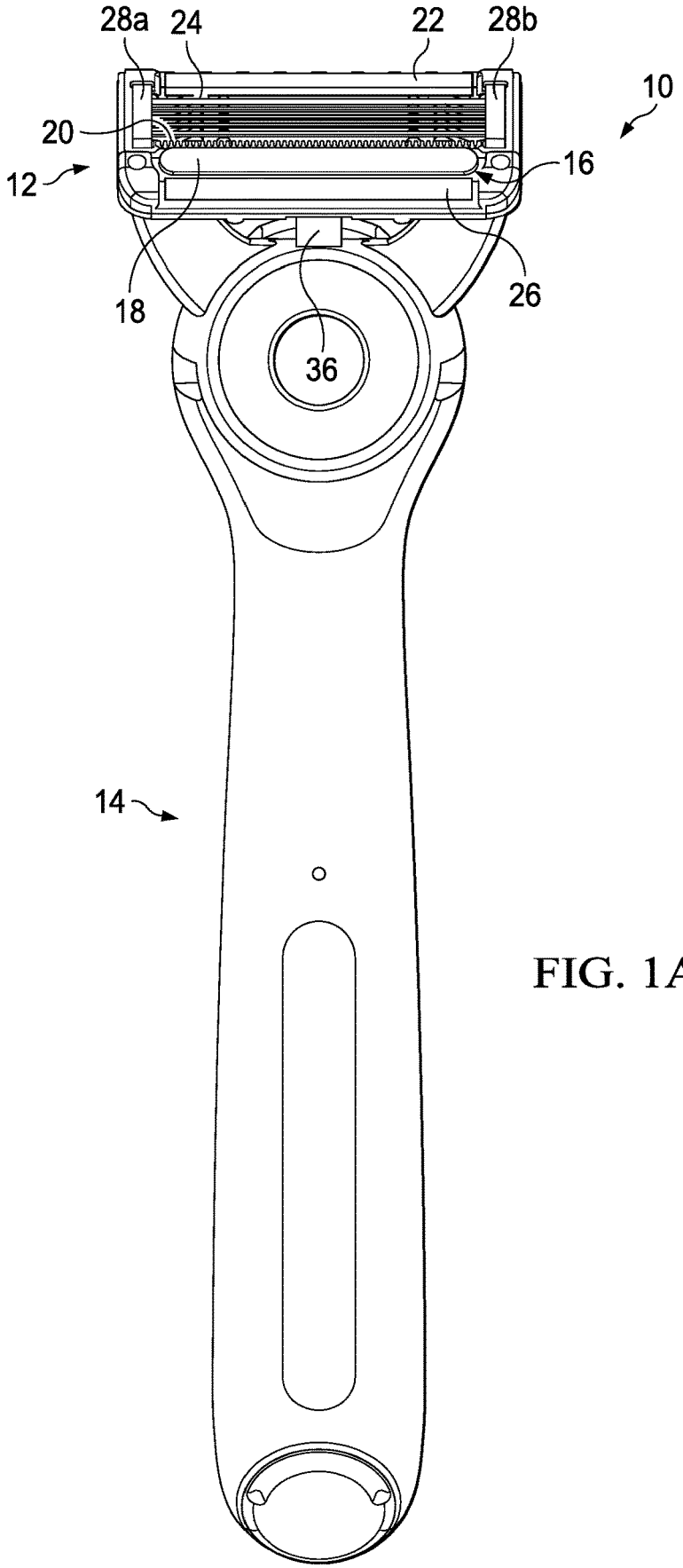
FIG. 1A is a bottom view of one possible embodiment of a shaving razor system.
Figure 1B:
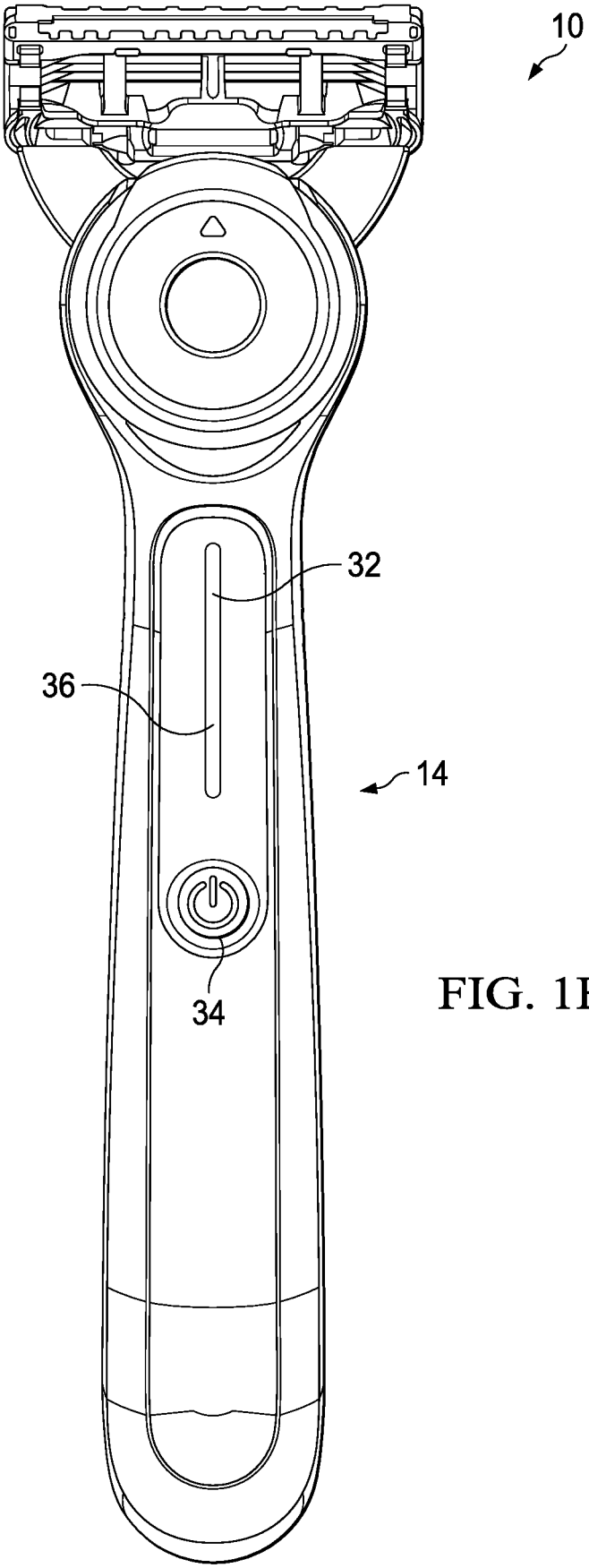
FIG. 1B is a top view of the shaving razor system of FIG. 1A.

Referring to FIGS. 1A and 1B, top and bottom views (respectively) of one possible embodiment of the present disclosure is shown illustrating a shaving razor system 10. In certain embodiments, the shaving razor system 10 may include a shaving razor cartridge 12 mounted to a handle 14. The shaving razor cartridge 12 may be fixedly or pivotably mounted to the handle 14, depending on the overall desired cost and performance of the shaving razor system 10. The handle 14 may hold a power source, such as one or more batteries (not shown) that supply power to a heating member 16 having a skin contacting surface 18. The heating member 16 may be a component of the handle 14 or the shaving razor cartridge 12. In certain embodiments, the heating element 16 may comprise a metal, such as aluminum or steel.

The shaving razor cartridge 12 may be permanently attached or removably mounted from the handle 14, thus allowing the shaving razor cartridge 12 to be replaced. The shaving razor cartridge 12 may have a guard 20, a cap 22 and one or more blades 24 between the cap 22 and the guard 20. The blades 24 may be secured to the shaving razor cartridge with one or more clips 28*a* and 28*b*. The guard 20 may be toward a front portion of the shaving razor cartridge 12 and the cap 22 may be toward a rear portion of the shaving razor cartridge 12 (i.e., the guard 20 is in front of the blades 24 and the cap is behind the blades 24). The guard 20 and the cap 22 may define a shaving plane that is tangent to the guard 20 and the cap 22. The guard 20 may be a solid or segmented bar that extends generally parallel to the blades 24. In certain embodiments, the shaving razor cartridge 12 may comprise a skin-engaging member 26 (e.g., a plurality of fins or an elastomeric pad) in front of the blades 24 for stretching the skin during a shaving stroke. The skin-engaging member 26 may be insert injection molded or co-injection molded to the shaving razor cartridge 12. However, other known assembly methods may also be used such as adhesives, ultrasonic welding, or mechanical fasteners. The skin engaging member 26 may have a Shore A hardness of about 20, 30, or 40 to about 50, 60, or 70. A softer material may enhance skin stretching, as well as provide a more pleasant tactile feel against the skin of the user during shaving. A softer material may also aid in masking the less pleasant feel of the blades 24 or the guard 20 against the skin of the user during shaving.

In certain embodiments, it may be desirable to provide heat in front of the blades 24. For example, the heating element 16 may be positioned in front of the guard 20 and behind the skin engaging member 26. The heating element 16 may comprise a skin contacting surface 18 (e.g., a face plate) that delivers heat to a consumer's skin during a shaving stroke for an improved shaving experience. As will be described in greater detail below, the heating element 16 may be mounted to either the shaving razor cartridge 12 or to a portion of the handle 14. It is understood that in other embodiments, the heating element may include heated blades or other skin contacting surfaces of the shaving razor cartridge or the handle 12.

As shown in FIGS. 1A and 1B, the heating element 16 may be controlled by an actuating member 34 (e.g., a button or a switch) in electrical communication with a power circuit (not shown) via a flexible circuit 36 (FIG. 1A). As will be explained in greater detail below, the handle 14 may include a light guide 32 having a transparent or translucent window 36 to indicate a status of the heating element 16. In certain embodiments, the actuating member 34 may act as a light guide to indicate the condition of the shaving razor system 10 (e.g., to indicate the power status or the heating level).

The cap 22 may be a separate molded (e.g., a shaving aid filled reservoir) or extruded component (e.g., an extruded lubrication strip) that is mounted to the housing 18. In certain embodiments, the cap 22 may be a plastic or metal bar to aid in supporting the skin and define the shaving plane. The cap 22 may be molded or extruded from the same material as the housing 18 or may be molded or extruded from a more lubricious shaving aid composite that has one or more water-leachable shaving aid materials to provide increased comfort during shaving. The shaving aid composite may comprise a water-insoluble polymer and a skin-lubricating water-soluble polymer. Suitable water-insoluble polymers which may be used include, but are not limited to, polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, may have a high impact polystyrene (i.e., Polystyrene-butadiene), such as Mobil 4324 (Mobil Corporation).

Figure 2:
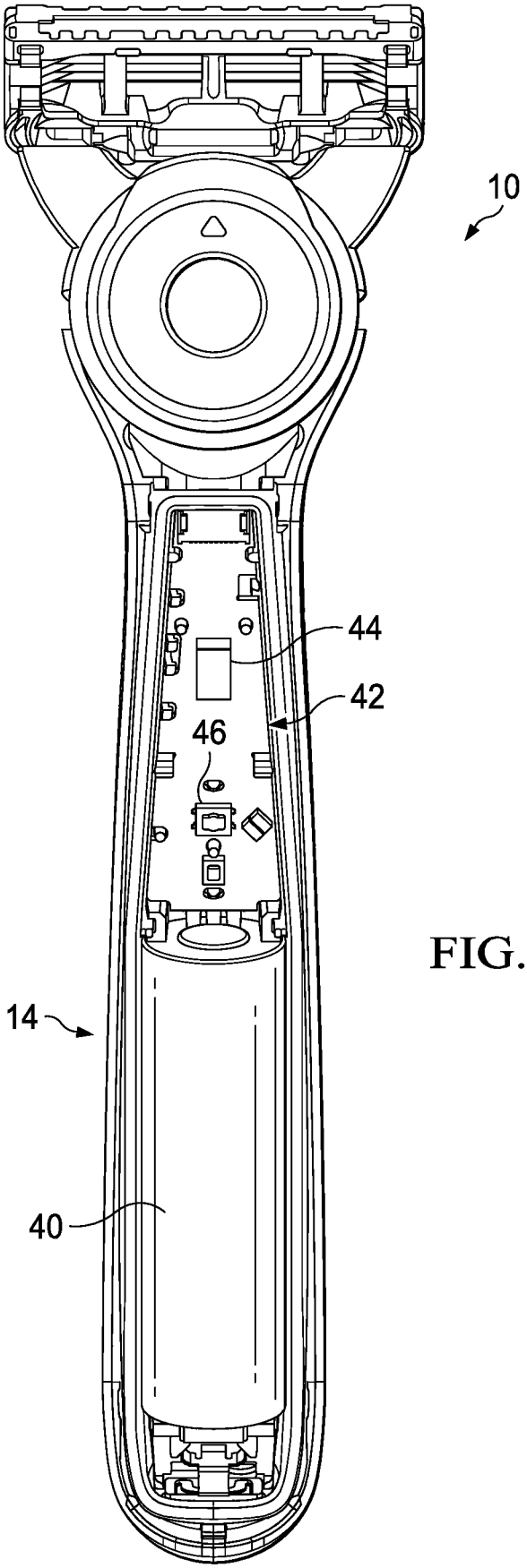
FIG. 2 is a top view of the shaving razor system of FIG. 1B with a portion removed.

Referring to FIG. 2, a top view of the shaving razor system of FIG. 1A is illustrated with a portion removed. The shaving razor system 10 may include a power source 40 (e.g., a rechargeable battery) positioned within the handle 14. The power source 40 may be in electrical contact with a circuit board 42 having a micro-controller 44. The actuating member 34 of FIG. 1B may include an electrical switch 46 that is in communication with the microcontroller 44 and the power source 40. For example, a consumer may contact the actuating member 34 which activates the electrical switch 46 positioned within the handle 14. In certain embodiments, the micro-controller 44 may set a first pre-determined temperature and a second pre-determined temperature for the heater element 16 of FIG. 1A. The second predetermined temperature may be at least two, three, four or five degrees Celsius different from the first pre-determined temperature. In certain embodiments, the first predetermined temperature may be about 43 degrees Celsius, which may represent a high percentage of consumers that can feel a comfortable level of heat during a shaving stroke. In certain embodiments, the second predetermined temperature may be about 48 degrees Celsius, which may represent the highest temperature that most consumers can tolerate and do not feel an uncomfortable level of heat (e.g., burning sensation) during a shaving stroke. The predetermined temperatures are temperature settings, which may vary slightly from the actual temperature at the skin interface. For example, as the user strokes the shaving razor cartridge 12 against the skin, the temperature may drop due to limited electrical heating power of the system.

The shaving razor system 10 having a heating element 16 (FIG. 1A) with a limited number of predetermined temperatures for heating the skin creates a more intuitive, safe and effective delivery of heat during a shaving stroke. It is believed, without being held to theory that much of the population can only tell a two degrees Celsius variance in temperature during shaving. A larger proportion of the population can tell a difference during a shaving stroke as the temperature difference increases to five degrees Celsius. Predetermined temperatures eliminate the guesswork for the consumer in choosing the proper temperature that will provide a comfortable level of heat without burning them.

Figure 3:
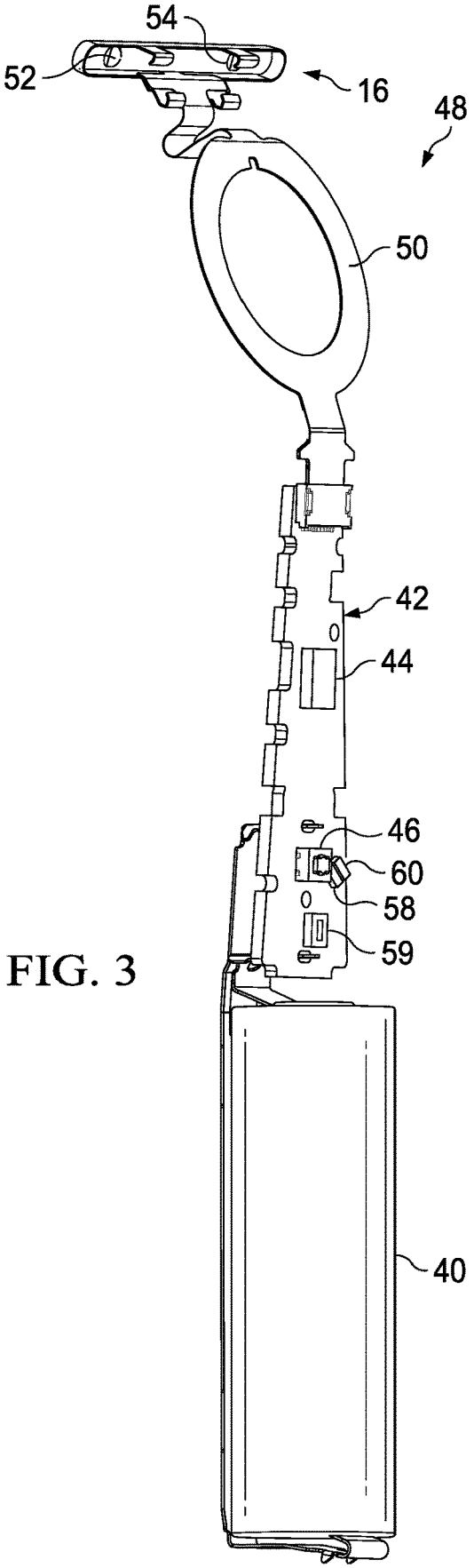
FIG. 3 is a perspective view of a heating system of the shaving razor system of FIG. 1A.

Referring to FIG. 3, a perspective view of a heating system 48 that may be incorporated into the shaving razor system 10 of FIG. 1A. The heating system 48 may include the power source 40, the circuit board 42, the electrical switch 46, a flexible electrical bridge 50 and the heating element 16. The heating element 16 may have at least one thermal sensor 52 and 54 for measuring the temperature of the heating element 16 and providing information to the microcontroller 44. The microcontroller 44 may be in electrical communication with the heating element 16 and the electrical switch 46.

The electrical switch 46 may toggle the heating element 16 between an on condition and an off condition. In the off condition, no power may be supplied to the heating element. Accordingly, the heating element 16 may be at ambient temperature in the off condition (e.g., after the heating element 16 has cooled down). In the on condition, the heating element 16 may be at the first pre-determined temperature or the second pre-determined condition. For example, when a consumer turns the heating element 16 to the off condition, the micro-controller 44 may store in memory if the heating element 16 was in the first pre-determined temperature or the second pre-determined temperature just prior to the off condition. The electrical switch 46 may toggle the heating element 16 between the first pre-determined condition and the second pre-determined condition. One or more LEDs 58, 59 and 60 may be positioned on the circuit board 42. The LEDs may be in electrical communication with the microcontroller 44 to indicate a condition of the heating element 16 and/or the status of power (e.g., an on or off condition).

It is believed without being held to theory that consumers toggle between the on condition and the off condition more than between the first pre-determined condition and the second predetermined condition. Once a consumer identifies a temperature setting that is enjoyable to them, they typically do not toggle to the other predetermined condition. In certain embodiments, the electrical switch may have a first toggle time for changing between the first pre-determined temperature and the second pre-determined temperature and a second toggle time for changing between the on condition and the off condition that are different. The first toggle time may greater than the second toggle time. It is believed, while not being limited to theory, that consumers will use the on/off functionality of the shaving razor system at least twice every time they use the device. For example, once to turn the device on and a second time to shut the device off. However, once a consumer identifies the temperature they prefer for a shave, they will rarely activate the functionality to change the temperature ever again. Accordingly, a shorter time for the on/off condition may be preferred because when the user is pressing the button their intention is more likely to turn off the device. For example, the first toggle time may be at least two seconds and the second toggle time may be less than two seconds.

Figure 4:
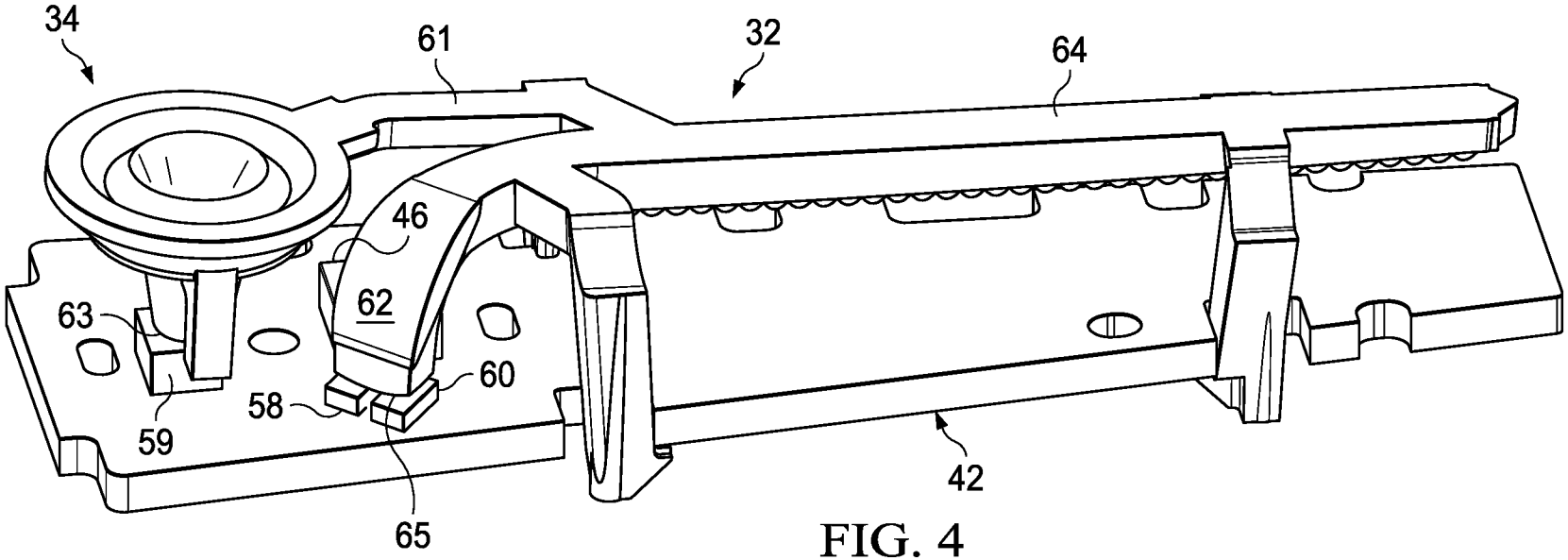
FIG. 4 is a perspective view of an electrical functional unit of the shaving razor system of FIG. 1A.

Referring to FIG. 4, a perspective view is shown of the light guide 32 mounted to the circuit board 42. Certain components have been removed from the circuit board 42 for clarity. A first LED 58 and a second LED 60 may be positioned on the circuit board 42. The microcontroller 44 (FIG. 3) may electronically activate the first LED 58 for the first predetermined temperature and the second LED 60 for the second predetermined temperature. In certain embodiments, the first LED 58 may be a different color than the second LED 60, thus allowing the consumer to easily determine if the heating element 16 is set to the first pre-determined temperature or the second pre-determined temperature. The light guide 32 may have an arm 62 extending from a body 64. The arm 62 may have a bottom surface 65 that faces the first LED 58 and the second LED 60. Accordingly, light may travel from the first LED 58 and the second LED 60 through the arm 62 and to the body 64 of the light guide 32. The arm 62 may contact the electrical switch 46 to turn on and off power.

A second arm 61 may extend from the body 64 to the actuating member 34. The actuating member 34 may have a bottom surface 63 that faces the third LED 59. Although only one LED 67 is shown positioned below the actuating member 34, it is understood there may be more than one LED having different colors, depending on the desired functionality and consumer feedback desired.

Figure 5:
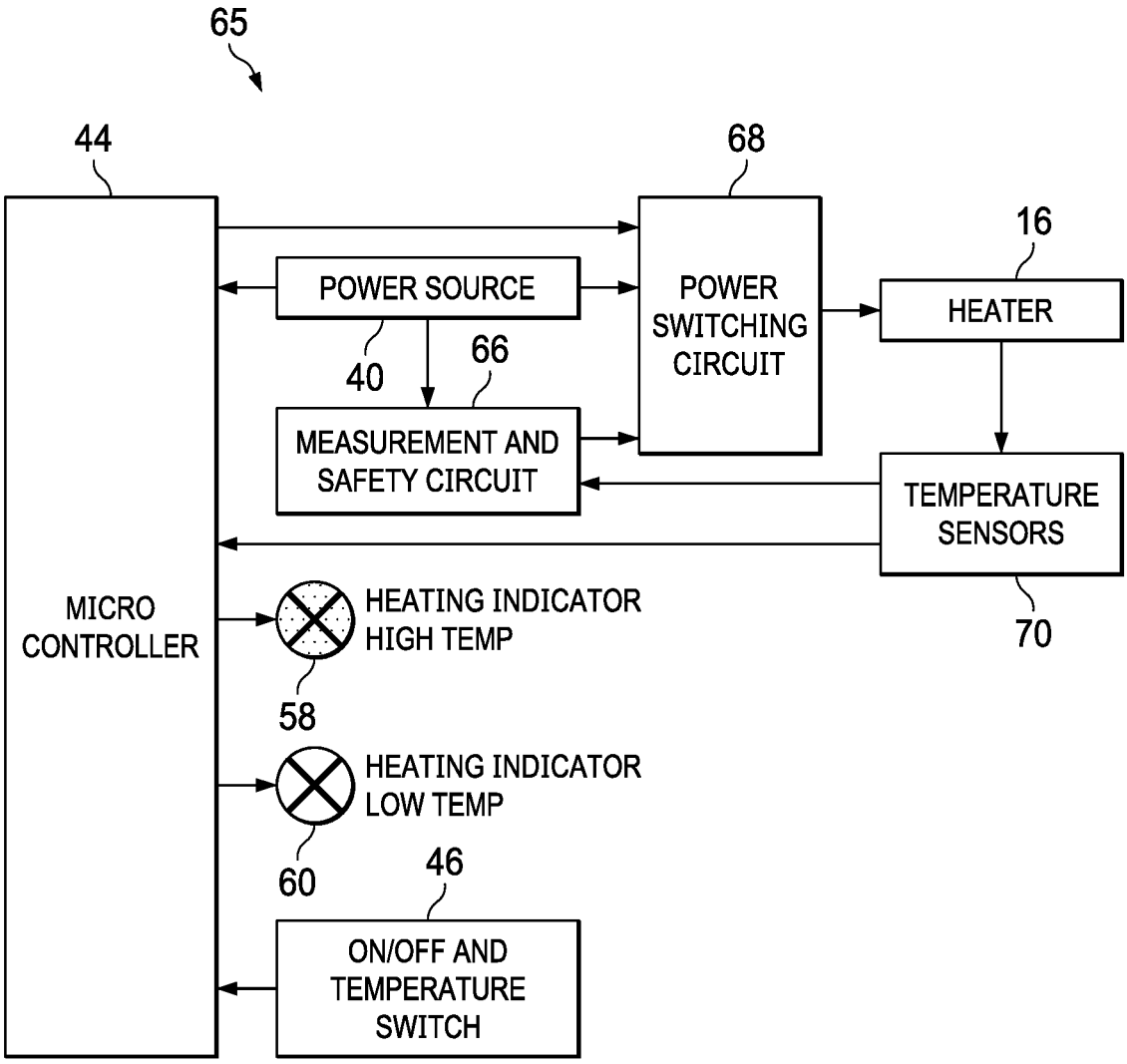
FIG. 5 is a first block diagram of the electrical components of the shaving razor system of FIG. 1A.

Referring to FIG. 5, one possible embodiment of a block diagram of an electrical system 65 for controlling the energy of the shaving razor system 10 of FIG. 1A is illustrated. The power source 40 (e.g., battery) may supply power to the microcontroller 44, a measurement and safety circuit 66 and a power switching circuit 68. The electrical switch 46 (labeled as ON/OFF AND TEMPERATURE SWITCH) may send a signal to the micro-controller 44. The micro controller 44 may then output a signal to one of the first LED 58 (e.g., high temperature heating indicator, labeled as labeled as HEATING INDICATOR HIGH TEMP) or the second LED 60 (e.g., low temperature heating indicator, labeled as HEATING INDICATOR HIGH TEMP) to indicate the desired temperature setting. The microcontroller 44 may also send an output signal to the power switching circuit 68, which sends a signal to the heating member 16 (labeled as HEATER) causing the heating member 16 to heat up to a specific predetermined temperature. One or more temperature sensors 70 measure the temperature from the heating member 16 and send a signal to the measurement and safety circuit 66 and the microcontroller 44. The measurement and safety circuit 66 sends a signal to the power switching circuit 68 in an event the temperature is above a certain threshold level (e.g., which may be uncomfortable or burn the skin). The power switching circuit 68 decreases or turns off power to the heating member 16 to bring down the temperature being measured by the temperature sensor(s) 70. The microcontroller 44 also receives a signal from the temperature sensor(s) 70. Accordingly, the microcontroller 44 may also decrease or turns off power to the heating member 16 to bring down the temperature being measured by the temperature sensor(s) 70. Accordingly, two independent systems are able to control the heating member 16 so it does not over heat, which may cause discomfort or burns to a consumer during shaving. The switch 46 may be pressed a second time to send another signal to the microcontroller 44 to change the temperature or to shut the power off. As previously described above, the microcontroller 44 determines what signal to send (e.g., an off signal to the power source 40 or a change in temperature signal to the power switching circuit 68) depending on how long the switch is pressed. The microcontroller 44 may send a signal to one of the LEDs 58, 60 to indicate the new set temperature and also a signal to the power switching circuit 68 to change the temperature of the heating member 16. Alternatively, the microcontroller 44 may send a signal to the power source 40 to shut power off to the power switching circuit 68, the measurement and safety circuit 66. The microcontroller 44 may also turn power off to both LEDs 58 and 60, thus indicating an off condition to the user.

Figure 6:
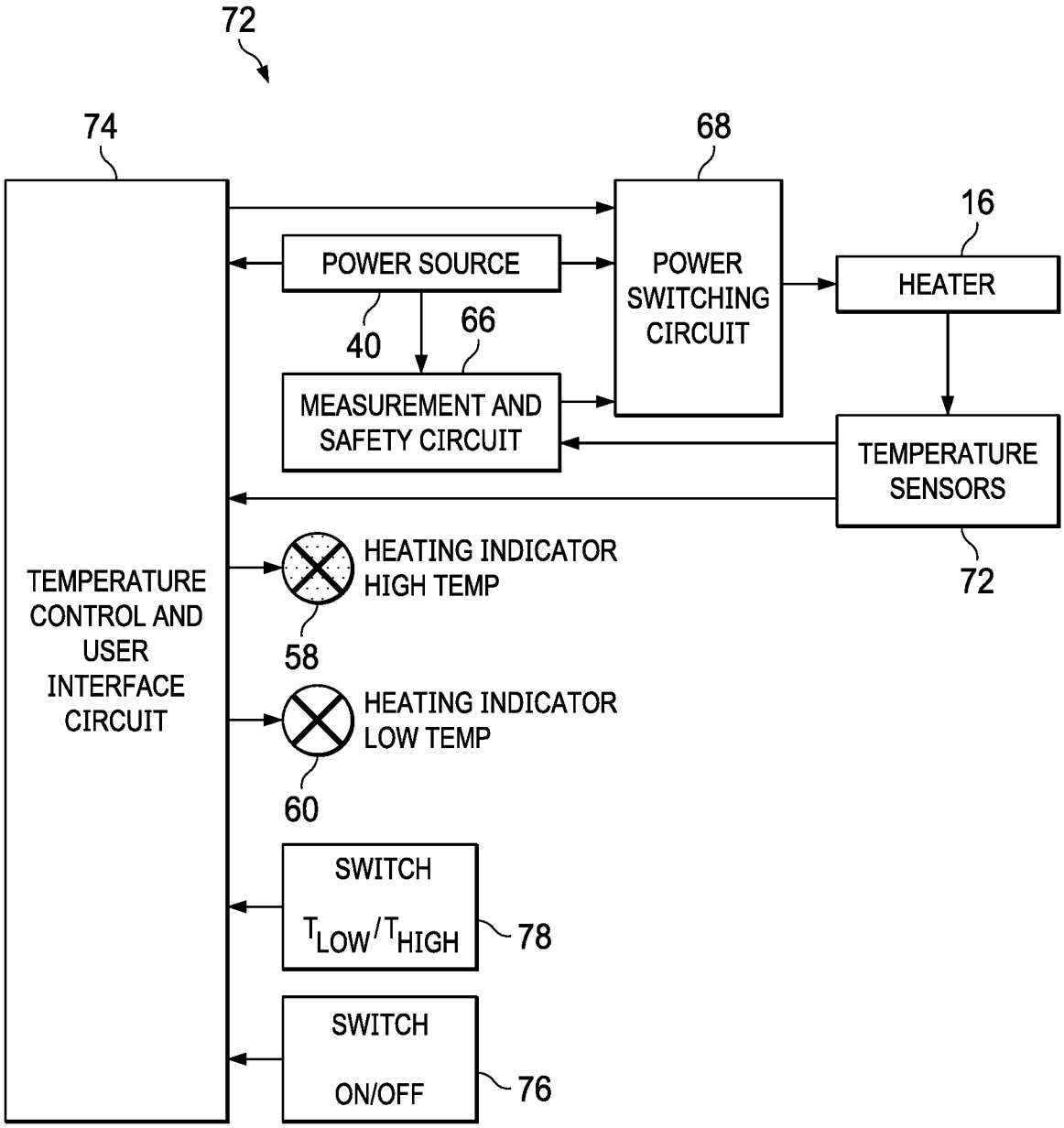
FIG. 6 is a second possible embodiment of a block diagram.

Referring to FIG. 6, another possible embodiment a block diagram of an electrical system 72 for controlling the energy of the shaving razor system 10 of FIG. 1A is illustrated. The electrical system 72 may have similar or the same components as the electrical system 65 of FIG. 5. For example, the electrical system 65 may substitute a temperature control and user interface circuit 74 for the microcontroller 44 of FIG. 5. In addition, the switch 46 may be replaced by two separate switches 76 and 78. The on/off switch 76 may turn power either on or off upon actuation. Temperature of the heating member 16 may be changed by actuating the temperature selection switch 78. The switch 78 may have a first position for a first temperature setting and a second position for a second temperature setting.

The power source 40 (e.g., battery) may supply power to the temperature control and user interface circuit 74, the measurement and safety circuit 66 and the power switching circuit 68. The switch 76 (labeled as SWITCH ON/OFF) may send a signal to the temperature control and user interface circuit 74. The temperature control and user interface circuit 74 may then output a signal to one of the first LED 58 (e.g., high temperature heating indicator, labeled as labeled as HEATING INDICATOR HIGH TEMP) or the second LED 60 (e.g., low temperature heating indicator, labeled as HEATING INDICATOR HIGH TEMP) depending on the position of the temperature selection switch 78, to indicate the desired temperature setting. The temperature control and user interface circuit 74 may also send an output signal to the power switching circuit 68, which sends a signal to the heating member 16 (labeled as HEATER) causing the heating member 16 to heat up to a specific predetermined temperature. One or more temperature sensors 72 measure the temperature from the heating member 16 and send a signal to the measurement and safety circuit 66 and the microcontroller 44. The measurement and safety circuit 66 sends a signal to the power switching circuit 68 in an event the temperature is above a certain threshold level (e.g., which may be uncomfortable or burn the skin). The power switching circuit 68 decreases or turns off power to the heating member 16 to bring down the temperature being measured by the temperature sensor(s) 72. The temperature control and user interface circuit 74 also receives a signal from the temperature sensor(s) 72. Accordingly, the temperature control and user interface circuit 74 may also decrease or turns off power to the heating member 16 to bring down the temperature being measured by the temperature sensor(s) 72. Accordingly, two independent systems are able to control the heating member 16 so it does not over heat, which may cause discomfort or burns to a consumer during shaving. The switch 78 may be pressed or changed to send another signal to the temperature control and user interface circuit 74 to change the temperature to a second predetermined temperature. The temperature control and user interface circuit 74 may send a signal to one of the LEDs 58, 60 to indicate the new set temperature and also a signal to the power switching circuit 68 to change the temperature of the heating member 16. The temperature control and user interface circuit 74 may send a signal to the power source 40 to shut power off to the power switching circuit 68, the measurement and safety circuit 66 if the switch 76 is changed to an off position. The temperature control and user interface circuit 74 may also turn power off to both LEDs 58 and 60, thus indicating an off condition to the user.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor system comprising:

a handle;

a shaving cartridge mounted to the handle;

a circuit board having an electrical switch in communication with a power source positioned within the handle;

a heating element in electrical communication with the electrical switch, the heating element having a skin contacting surface, wherein the heating element has a first pre-determined temperature and a second pre-determined temperature, and the second pre-determined temperature is at least two degrees Celsius different from the first pre-determined temperature and;

a microcontroller in electrical communication with the heating element and the electrical switch; wherein the electrical switch has a first toggle time for changing between the first pre-determined temperature and the second pre-determined temperature and a second toggle time for changing the heating element between an on condition and an off condition.

2. The shaving razor system of claim 1 wherein at least one of the first pre-determined temperature and the second pre-determined temperature is set by the microcontroller.

3. The shaving razor system of claim 1 wherein the second pre-determined temperature is at least four degrees Celsius different from the first pre-determined temperature.

4. The shaving razor system of claim 1 wherein the second pre-determined temperature is a four to five degrees Celsius different from the first pre-determined temperature.

5. The shaving razor system of claim 4 wherein the second toggle time is less than two seconds.

6. The shaving razor system of claim 1 wherein the electrical switch toggles the heating element between the on condition and the off condition.

7. The shaving razor system of claim 6 wherein the on condition comprises the heating element in the first pre-determined temperature or the heating element in the second pre-determined temperature.

8. The shaving razor system of claim 1 wherein the first toggle time is greater than the second toggle time.

9. The shaving razor system of claim 8 wherein the first toggle time is at least 2 seconds.

10. The shaving razor system of claim 1 further comprising at least one thermal sensor in communication with the microcontroller for measuring the temperature of the heating element.

11. The shaving razor system of claim 1 wherein the first pre-determined temperature is 43 degrees Celsius.

12. The shaving razor system of claim 11 wherein the second pre-determined temperature is 48 degrees Celsius.

13. The shaving razor system of claim 1 further comprising a first LED and a second LED, and wherein the microcontroller activates the first LED for the first pre-determined temperature and activates the second LED for the second pre-determined temperature.

14. The shaving razor system of claim 13 wherein the first LED is a different color than a color of the second LED.

15. A shaving razor system comprising:

a handle;

a shaving cartridge mounted to the handle;

an electrical switch in communication with a microcontroller positioned within the handle;

a heating element in communication with the microcontroller, the heating element having a skin contacting surface, the heating element having a first pre-determined temperature set by the microcontroller and a second pre-determined temperature set by the microcontroller; and the electrical switch having a first toggle time for changing back and forth between the first pre-determined temperature and the second pre-determined temperature and a second toggle time for changing back and forth between an on condition and an off condition of the heating element, wherein the first toggle time is greater than the second toggle time.

16. The shaving razor system of claim 15 wherein the first pre-determined temperature is at least four degrees Celsius different than the second pre-determined temperature.

17. The shaving razor system of claim 15 wherein the first toggle time is at least 2 seconds and the second toggle time is less than two seconds.

18. The shaving razor system of claim 15 wherein in the on condition, the microcontroller sets the heating element to a last pre-determined temperature used.

* * * * *